US007832067B2

(12) United States Patent
Tarrell

(10) Patent No.: US 7,832,067 B2
(45) Date of Patent: Nov. 16, 2010

(54) THREE-DIMENSIONAL CAMOUFLAGE PATTERN

(75) Inventor: Everett Tarrell, Sidney, NE (US)

(73) Assignee: Cabela's, Inc., Sidney, NE (US)

( * ) Notice: Subject to any disclaimer, the term of this patent is extended or adjusted under 35 U.S.C. 154(b) by 0 days.

(21) Appl. No.: 12/017,854

(22) Filed: Jan. 22, 2008

(65) Prior Publication Data

US 2009/0274878 A1 Nov. 5, 2009

Related U.S. Application Data

(62) Division of application No. 11/175,019, filed on Jul. 5, 2005, now abandoned.

(51) Int. Cl.
*D06C 11/00* (2006.01)

(52) U.S. Cl. ..... 26/27; 28/160; 428/88

(58) Field of Classification Search ..... 26/2 R, 26/8 R, 27, 29 R, 31; 28/159, 160; 66/194; 139/2, 391; 428/85, 88, 89, 90, 91, 92, 919; 442/101, 102, 103, 104, 109
See application file for complete search history.

(56) References Cited

U.S. PATENT DOCUMENTS 4,298,414 A 11/1981 Latapie et al.
4,528,229 A 7/1985 Gottlieb
4,656,065 A 4/1987 Yacovella
4,931,320 A 6/1990 Leonard
5,445,863 A 8/1995 Slagle et al.
5,486,385 A 1/1996 Bylund et al.
5,695,835 A 12/1997 Weber et al.
5,773,101 A 6/1998 Sanders
6,499,141 B1 12/2002 Egnew
6,751,831 B2 6/2004 Willauer et al.
6,787,212 B2 9/2004 Strength et al.
7,229,680 B1 6/2007 Crompton
2002/0010652 A1 1/2002 Deguchi
2002/0142112 A1 10/2002 Tarrell
2002/0152532 A1 10/2002 Hardy
2002/0152559 A1 10/2002 Muirhead

*Primary Examiner*—Arti Singh-Pandey
(74) *Attorney, Agent, or Firm*—K&L Gates LLP

(57) ABSTRACT

The stealthiness of a camouflage fabric product is enhanced by rendering the camouflage pattern in three dimensional relief. In one implementation, a treatment such as an anti-pill treatment is applied to selected portions of the pattern prior to a finishing process. In the case of a circular web fabric, the finishing process may involve fleecing the fabric. In this manner, a cost effective process is provided for constructing a three-dimensional relief camouflage fabric product.

6 Claims, 5 Drawing Sheets

THREE-DIMENSIONAL CAMOUFLAGE PATTERN

CROSS REFERENCE TO RELATED APPLICATION

This application is a divisional of U.S. patent application Ser. No. 11/175,019, which was filed on Jul. 5, 2005, and is entitled "THREE-DIMENSIONAL CAMOUFLAGE PATTERN." The entire disclosure of U.S. patent application Ser. No. 11/175,019 which is now abandoned, but incorporated herein by reference.

FIELD OF THE INVENTION

The present invention relates in general to camouflage fabric products and, in particular, to camouflage fabric products with three-dimensional relief features and cost effective processes for manufacturing such products.

BACKGROUND OF THE INVENTION

Camouflage fabric products are used in a variety of environments by a variety of users including hunters, soldiers and wildlife photographers or officials. Such products include coats, hats, pants, boots and other articles of clothing as well as cases, canopies, tents and other articles. Generally, it is desired that the products be stealthy—at least visually and in many cases aurally.

In order to achieve visual stealth, the fabric often includes a pattern having colors and a design selected to blend into the target environment. For example, the pattern may include vegetation features such as limbs and leaves printed on a suitable background, all provided in colors that will blend into the natural surroundings of the target environment. In other cases, a solid color may be employed. Moreover, a fabric may be selected that reflects little light to enhance stealthiness. Aural stealthiness generally involves selecting a fabric that allows for quiet movements, e.g., a soft fabric.

In order to achieve these desired properties, camouflage products are often formed from a circular web material such as fleece. These materials generally have a longer nap that is achieved through a finishing process where the product is brushed or fleeced in a manner that makes the surface fibers of the fabric stand up.

SUMMARY OF THE INVENTION

It has been recognized that the stealthiness of camouflage fabric products may be enhanced by rendering the pattern in three-dimensional relief; for example, by processing the fabric so that certain areas of the pattern stand out from other areas. In particular, two-dimensional patterns have an unnatural flatness that may allow for detection of the overall product shape thus defeating the desired camouflage effect, particularly when it is desired to elude detection by certain animals that have vision highly adapted to discern textures and shapes. Accordingly, it would be highly desirable to provide a three-dimensional texture, particularly in coordination with the camouflage design, so as to better obscure the shape of the overall product and avoid detection.

In accordance with one aspect of the present invention, a method is provided for use in constructing a camouflage fabric product. The method involves providing a camouflage fabric having a camouflage pattern, selecting a first portion of the pattern to be rendered in three-dimensional relief such that the first portion stands out from the second portion of the pattern, and selectively processing the fabric such that the pattern is rendered in the desired three-dimensional relief. In one implementation, the step of selectively processing comprises applying a treatment such as an anti-pill treatment to the second portion prior to a finishing process. The fabric may be a circular web fabric and the finishing process may involve fleecing the fabric. In this manner, a cost effective process is provided for constructing a three-dimensional relief camouflage fabric product with improved stealthiness.

In accordance with another aspect of the present invention, a three-dimensional camouflage pattern product is provided. The product includes a fabric with a camouflage pattern including a first portion and a second portion, where the pattern is rendered in three-dimensional relief such that the first portion stands out from the second portion. The pattern may include an additional area or areas with a height or heights different from that of the first and second areas. For example, the fabric may be a circular web fabric and the different heights may be achieved via application of an anti-pill treatment before fleecing. In this regard, the product (which may be an intermediate product within a production process) may include an anti-pill treatment disposed on the second portion.

BRIEF DESCRIPTION OF THE DRAWINGS

For a more complete understanding of the present invention and further advantages thereof, reference is now made to the following detailed description taken in conjunction with the drawings, in which.

DETAILED DESCRIPTION

In the following description, the invention is set forth in the context of a particular process for forming a three-dimensional camouflage pattern that involves printing an anti-pill treatment on selected portions of the camouflage pattern prior to a finishing process so that the treated portions are protected from the finishing process and remain flat rather than fleeced. This provides a particularly cost effective process for providing the desired three-dimensional relief. However, it will be appreciated that other processes for providing the desired effect may be implemented in accordance with the present invention. Accordingly, the following description should be understood as illustrating the invention and not by way of limitation.

Figure 1:
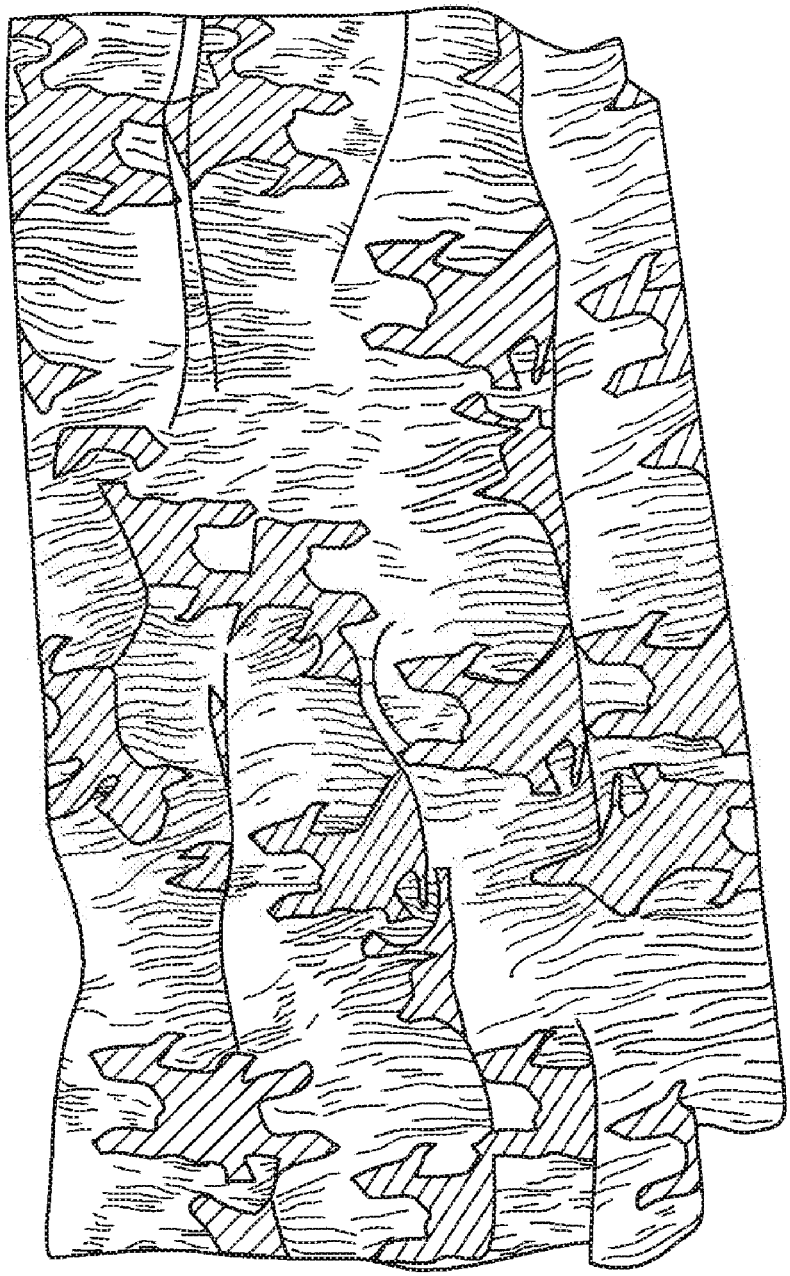
FIGS. 1 and 2 illustrate examples of camouflage patterns that may be rendered in three-dimensional relief in accordance with the present invention.
Figure 2:
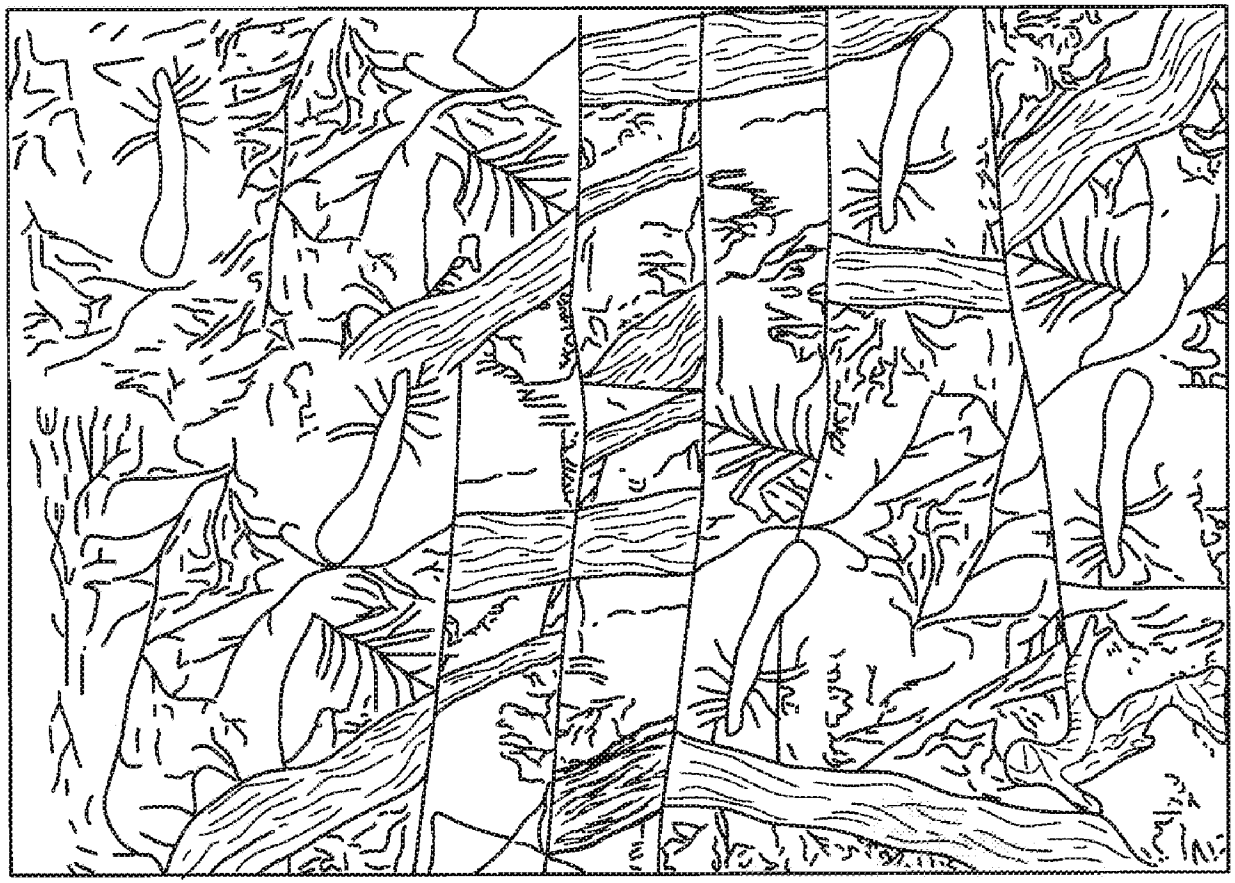

FIGS. 1 and 2 illustrate examples of camouflage patterns that may be rendered in three-dimensional relief in accordance with the present invention. Generally, camouflage patterns include a number of areas of varying colors. The boundaries between the various colors are intended to obscure the shape of the product so as to avoid detection. For example, in the case of camouflage clothing, the outline of the person wearing the clothing will be less readily perceived due to the camouflage effect. In this regard, the pattern may be somewhat abstract, as depicted in FIG. 1, for example to mimic a pattern of shading or filtered light, or may include vegetation features such limbs and leaves as shown in FIG. 2. In either case, it will be appreciated that the pattern includes a number of areas, generally of somewhat contrasting color, separated by defined boundaries.

Figure 3:
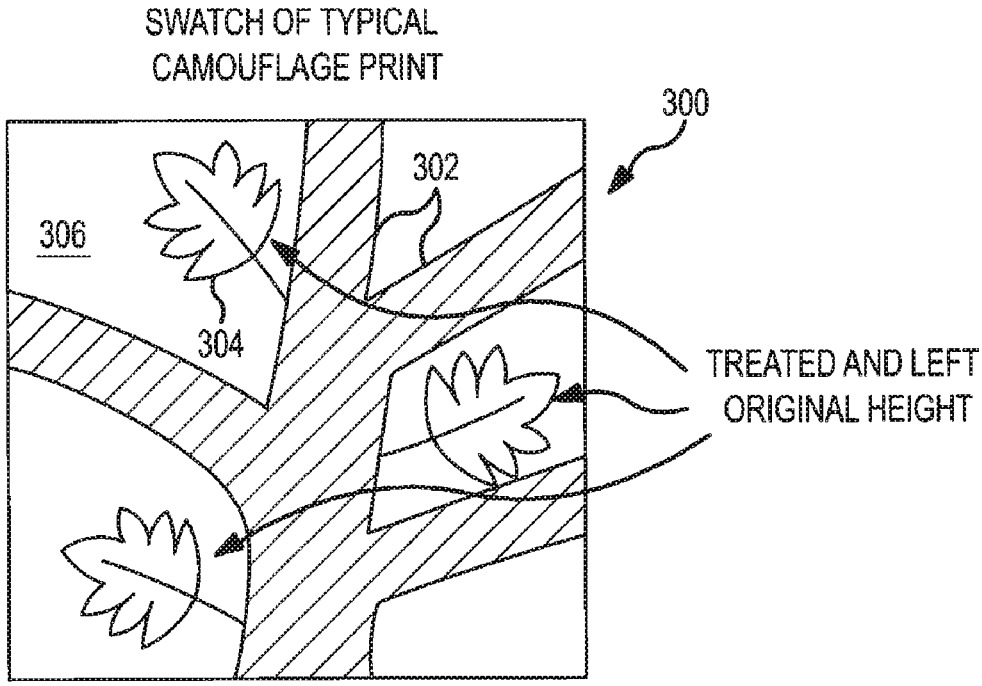
FIG. 3 illustrates a simplified camouflage pattern for purposes of illustrating the present invention.

FIG. 3 illustrates a somewhat simplified camouflage pattern for purposes of illustrating the present invention. Specifically, the pattern 300 includes branches or twigs 302 and leaves 304 on a background 306. Generally, colors are selected for the patterns so as to blend into the surrounding environment. Thus, in this case, the leaves may be green, the limbs may be brown and the background may be gray. This pattern is generally printed on the fabric by any of various well-known processes. In this regard, a fabric such as a circular web fabric as may be desired for camouflage applications may be processed so as to print the desired pattern using an automated or semi-automated machine. The machine may be operated, for example, to print individual colors in series or to apply multiple colors in a single pass. In any event, application of the pattern and, hence, definition of the features and boundaries is well controlled.

In accordance with the present invention, after printing a color, a treatment is selectively applied only to selected portions of the pattern. For example, only certain colors may be treated. In one implementation, an anti-pill treatment is applied to selected portions of the pattern, for example, to only the green leaves in the noted pattern. The anti-pill treatment causes the treated areas to remain at their original height after a finishing process, such as fleecing, that causes untreated areas to stand out from the treated areas. That is, the untreated areas become fleecy in appearance.

Figure 4:
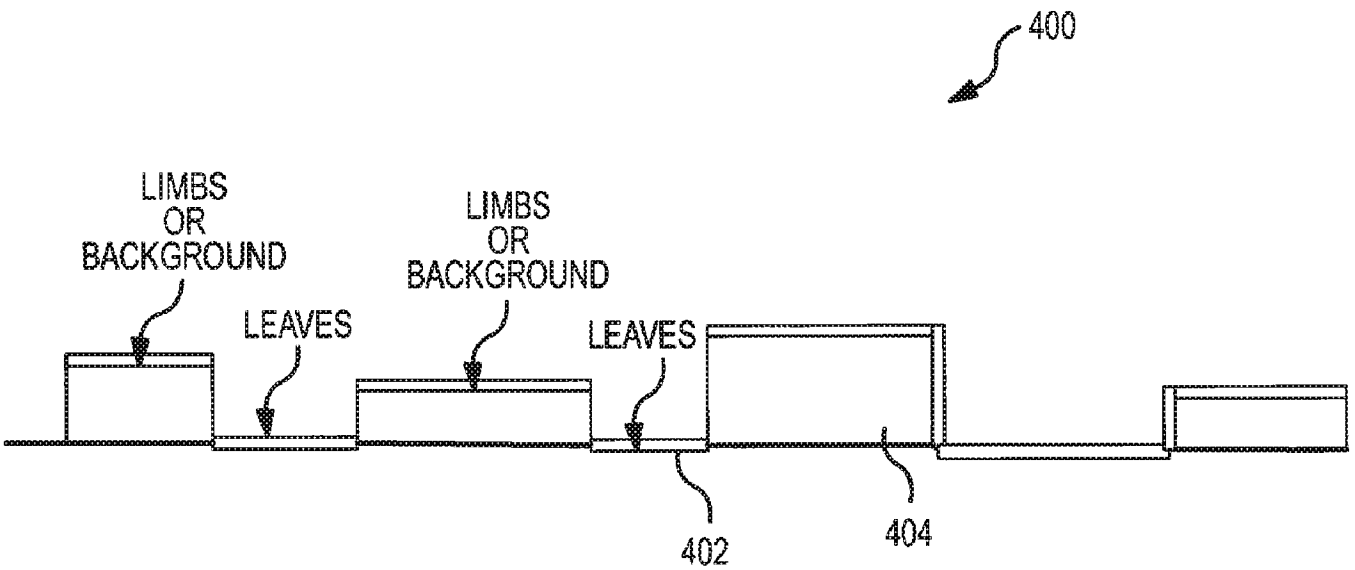
FIG. 4 is a cross-sectional view of fabric formed in accordance with the present invention illustrating the three-dimensional relief of the camouflage pattern.

FIG. 4 is a cross-section view of the fabric showing this three-dimensional relief. As shown, after the finishing treatment, the fabric 400 includes flat portions 402 and raised or fleeced portions 404. For example, the flat portions 402 may correspond to the leaves of the camouflage design and the fleecy portion 404 may correspond to the limbs and/or background. In this manner, three-dimensional relief or texturing is imparted to the camouflage pattern so as to improve the camouflage effect. Although FIG. 4 illustrates the fabric as including a binary three-dimensional effect where features are either flat or fleeced, it will be appreciated that various degrees of flatness or fleeciness may be achieved, for example, by controlling the amount of the anti-pill treatment applied, controlling the amount of fleecing applied in connection with the finishing process, by applying the anti-pill treatment as an intermediate step during the finishing process, or the like.

Figure 5:
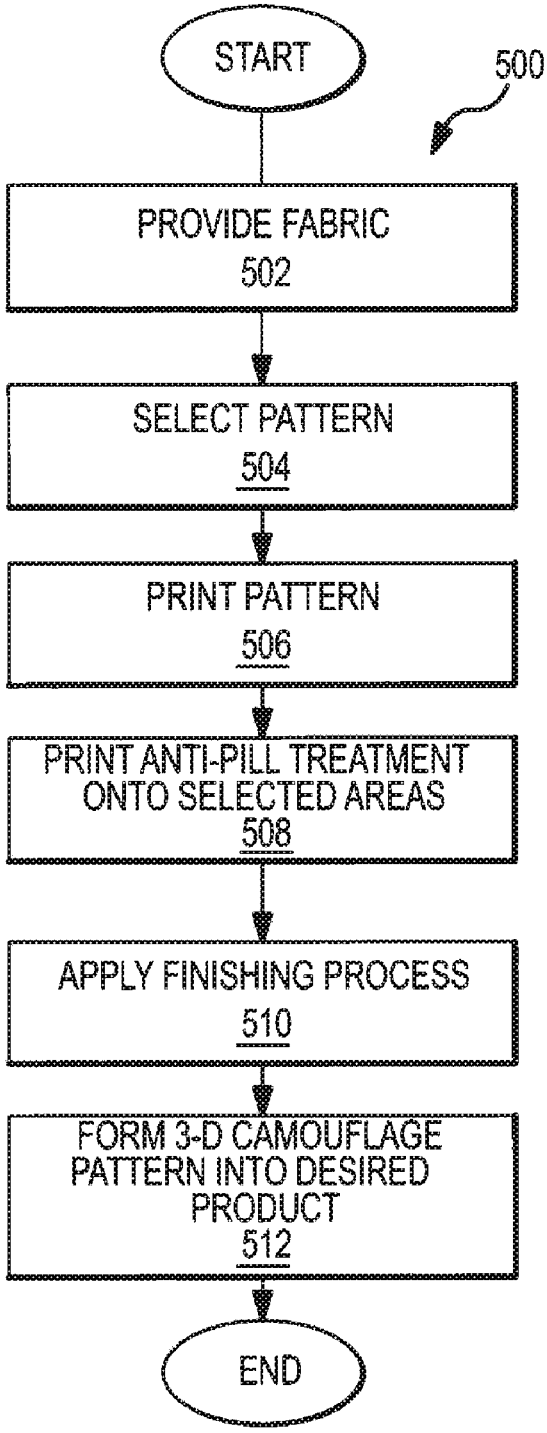
FIG. 5 is a flow chart illustrating a process for forming a three-dimensional camouflage fabric product in accordance with the present invention.

FIG. 5 is a flow chart illustrating a process 500 for forming a three-dimensional camouflage fabric product in accordance with the present invention. This illustrated process 500 is initiated by providing (502) a fabric such as a circular web material. A pattern is then selected (504) for the camouflage effect. For example, as noted above, the pattern may include vegetation features or more abstract patterning. The pattern is then printed (506) on the fabric using an automated or semi-automated printing process as described above. The anti-pill treatment is then printed (508) on to selected pattern areas, for example, corresponding to certain colors of the pattern or certain vegetation features.

The finishing process is then applied (510) such as by brushing or fleecing such that untreated areas rise in relation to the treated areas which remain more flat. The resulting three-dimensional camouflage pattern fabric is then formed (512) into the desired product, such as an article of clothing or other article.

While various embodiments of the present invention have been described in detail, it is apparent that further modifications and adaptations of the invention will occur to those skilled in the art. However, it is to be expressly understood that such modifications and adaptations are within the spirit and scope of the present invention.

What is claimed:

1. A method for use in constructing a camouflage fabric product, comprising the steps of:

providing a circular web fabric having a camouflage pattern printed on a top surface that is substantially free from three-dimensional relief;

selecting a first portion of said pattern to be rendered in three-dimensional relief such that said first portion stands out from a second portion of said pattern;

applying an anti-pill treatment to the second portion of the pattern;

brushing or fleecing the top surface of the fabric, subsequent to applying the anti-pill treatment, to raise surface fibers of the first portion of the pattern to a height that is above a height of a surface of the second portion of the pattern such that said pattern is rendered in three-dimensional relief.

2. A method as set forth in claim 1, wherein said camouflage pattern includes at least vegetation features.

3. A method as set forth in claim 2, wherein said first portion includes said vegetation feature.

4. A method as set forth in claim 2, wherein said vegetation feature comprises one of a leaf and a limb.

5. A method as set forth in claim 1, wherein said step of providing comprises applying said pattern to said fabric.

6. A method as set forth in claim 1, further comprising:

processing said fabric such that a third portion of said fabric has a height different than that of each of said first and second portions.

* * * * *